United States Patent [19]

Whitlock

[11] 3,998,017

[45] Dec. 21, 1976

[54] LOG BUILDING STRUCTURE

[76] Inventor: Donald M. Whitlock, P.O. Box 278, Troutville, Va. 24175

[22] Filed: July 28, 1975

[21] Appl. No.: 599,332

[52] U.S. Cl. ..... 52/233; 52/306

[51] Int. Cl.[2] ..... E04B 1/10

[58] Field of Search ..... 52/233, 306

[56] References Cited

UNITED STATES PATENTS

| | | | |
|---|---|---|---|
| 2,130,231 | 9/1938 | Forceia | 52/233 |
| 2,463,612 | 3/1949 | Grudda | 52/233 |
| 2,712,678 | 7/1955 | Jensen | 52/233 |
| 3,460,301 | 8/1969 | Davis | 52/233 |
| 3,527,005 | 9/1970 | Slavens | 52/233 X |

*Primary Examiner*—Price C. Faw, Jr.
*Assistant Examiner*—Carl D. Friedman
*Attorney, Agent, or Firm*—Cain and Henn

[57] ABSTRACT

A building structure which utilizes logs or timbers of readily available dimensions. A plurality of timbers are horizontally disposed in parallel, vertically spaced relationship to form wall sections. Intermediate each pair of adjacent horizontal timbers there is a pair of convex panels of flexible synthetic resinous material, symmetrically disposed about the vertical axis. Upper and lower edges of each panel are inserted into oblique panel-receiving slots provided in the upper and lower surfaces of each horizontal timber. The panels are preferably inserted after assembly of the timbers and support no direct load. Insulating material is placed between each pair of panels. The panels may be inserted during or after assembly of overlapping end surfaces of timbers of end-adjacent vertical walls. If desired, insulating material may be inserted in the confined zone between panels and successive logs. Preferably, substantially light-permeable panel members are used and substantially light-permeable insulating means is used between panel members to permit natural lighting of the interior of the building structure during daylight hours.

11 Claims, 7 Drawing Figures

LOG BUILDING STRUCTURE

BACKGROUND OF THE INVENTION

The nostalgia of a log cabin has been transmitted from generation to generation and a charming pioneering ambience has been captured in many a recently built log cabin. By and large such log cabin structures have often been built lately, despite the readily availability of other materials, at greater cost than a comparable modern structure built with masonry or modern materials in the form of large panels.

Recently, however, due to the upward pressure on building costs because of the high cost of man-made materials, finished lumber, masonry and the concomitant large expenditures for high-priced labor, it has become increasingly evident that the use of a renewable resource such as lumber, in a manner designed to minimize the man-hours of skilled labor required for construction, has great merit. Yet, a log building constructed essentially of closely abutting logs or timbers necessitates the use of so large a number of timbers as to negate the cost advantage attributable to the use of timbers for structural purposes. In other words, solid timber walls fabricated by a plurality of logs of suitable cross-section one resting directly upon another, or interlockingly engaged with one another, require too many timbers to be economical. Surprisingly, by utilizing fewer timbers to suppress material costs, and substituting twin plastic panels in lieu of timbers, it is possible to construct a structurally sound, well-insulated building without sacrificing the essential log cabin appearance of the building.

Of particular interest in the prior art is the playhouse structure disclosed in U.S. Pat. No. 1,936,571 to J. E. Bauman, wherein simulated logs are provided in their upper and lower faces with central channels or grooves in which filler pieces or strips are inserted. The simulated logs and filler pieces are built up sequentially along the side edges of an entrance panel which must be pre-positioned in the grooves of logs which eventually engage the four sides of the panel. The wall units so constructed are keyed together in direct load bearing relationship with each other, and additionally, vertical corner fastening rods are provided which clamp the wall units together.

Also of interest are U.S. Pat. Nos. 1,813,455 to H. B. Lawton and 2,130,231 to E. A. Forceia wherein courses of logs are in tongue and groove relationship, being keyed together by single and twin key means, respectively. It is apparent that in each case, the tongues or keys are obscured by overlying logs and that the function of the key means is to interlock successive logs by preventing relative movement therebetween.

SUMMARY OF THE INVENTION

It is a general object of the instant invention to provide a new and improved log cabin structure for residential and other full-scale, adult all-year uses fabricated of a naturally renewable resource, namely logs or timbers, and plastic panel members.

It is another general object of the instant invention to provide a new and improved log cabin structure fabricated of logs or timbers requiring only a simple machining operation, and plastic panel members requiring no machining.

It is also a general object of the instant invention to provide a new and improved log cabin structure fabricated only from horizontal log or timber members and having no vertical log or timber members.

It is still another general object of the instant invention to provide a new and improved log cabin structure fabricated by overlying the ends of alternate timbers of two end-adjacent essentially vertical walls.

It is a further general object of this invention to provide a new and improved process for fabricating a wall structure of horizontal logs or timbers alternated with opposed spaced apart flexible panels, comprising fastening plural horizontal pre-grooved log member in alternatively overlapping end-adjacent relationship so as to form a pair of angularly disposed vertical walls, inserting an outer panel with its upper edge in an upper groove and its lower edge in a lower groove, inserting an inner panel with its upper edge in an outer groove and its lower edge in a lower groove, so as to form a thermally insulating confined zone between adjacent horizontally disposed logs, and optionally, placing insulating material within said confined zone.

It is a further general object of the instant invention to provide a new and improved log cabin structure fabricated by fastening the ends of timber by a simple fastening means, one timber fastened to each next adjacent timber.

It is another general object of this invention to provide a plastic and wood building which is moderately priced, essentially free of maintenance, yet uniquely attractive.

It is another general object of this invention to provide a plastic and wood building which is constructed of materials which are rendered highly fire-resistant by currently available technological improvements.

It is another specific object of this invention to provide a plastic and wood building which can be easily cleaned inside and out.

It is still another specific object of this invention to provide a plastic and wood building which has flexibility of design and lends itself to being easily modified for any desired size of structure.

It is a further specific object of this invention to provide a plastic and wood building which may be built with varied timbers and plastic panels to change the appearance of each structure.

It is yet a further specific object of this invention to provide a plastic and wood building which may be constructed very quickly, utilizing unskilled or semi-skilled labor.

It is another general object of this invention to provide a log cabin structure fabricated from logs having an arbitrary, though essentially the same, cross-section and any desired length.

It is also another general object of this invention to provide a log cabin wall structure which lends itself to adaptation for use with conventional walls of building materials such as stone and/or brick, adding substantially to the appeal of the structure, yet at lower cost than conventional walls.

It is a more specific object of this invention to provide a log cabin structure fabricated of commercially available timbers between which a pair of longitudinally extending plastic elongated panel members is disposed, one plastic panel in parallel, laterally spaced apart relationship from the other.

It is another specific object of this invention to provide a thermal insulating zone between adjacent, parallel, vertically spaced apart log members of a wall, without using another log or wood member therebetween.

It is also another specific object of this invention to provide a thermal insulating zone between adjacent vertically spaced apart parallel log members without sacrificing the rustic log cabin appearance of the structure.

It is yet another specific object of this invention to provide a thermal insulating zone between adjacent, parallel, spaced apart log members comprising a pair of laminar flexible panel members of a synthetic resinous material, preferably reinforced with fibrous filler material such as glass fibers, the panel members being inserted between adjacent log members in parallel laterally spaced apart relationship to define an air space substantially the same width as a log member.

It is still another specific object of this invention to provide a thermal insulating zone between adjacent, parallel, spaced apart log members without transmitting a load on the material between the log members through the log members.

It is still a further specific object of this invention to provide a wall structure fabricated of timbers having an arbitrary cross-section and horizontal upper and lower surfaces in each of which a pair of parallel spaced apart grooves is provided.

It is another specific object of this invention to provide a wall structure fabricated of timbers having pre-grooved upper and lower surfaces, in which grooves no-load-bearing panel members may be inserted either during assembly of logs to form a wall, or after assembly of the wall.

It is a further specific object of this invention to provide a wall structure having a thermal insulating zone comprising oppositely disposed elongated panel members between upper and lower log member surfaces, including insulating material in said zone.

It is yet a further specific object of this invention to provide a wall structure having a thermal insulating zone comprising oppositely disposed elongated panel members between upper and lower log surfaces, said zone including space in which may be placed electrical conduit means, plumbing conduit means for hot and cold water, and air duct means and the like.

Still further objects of this invention include the provision of a new and improved wall structure for a building fabricated in large part of a renewable natural resouce, namely lumber; which wall structure utilizes only horizontal log members or timbers; which timbers are used in combination with economically available plastic panel members to provide a useful structural wall having exceptional heat insulating characteristics; which timbers are grooved in a simple fashion to snugly accommodate upper and lower edges of oppositely disposed continuous laminar plastic panel means so as to form a heat-insulating zone between adjacent timbers; which heat-insulating zone may include insulating means such as a batt of insulating fibrous materials; which wall structure is simple and fool-proof for fabrication by unskilled labor; wherein end-adjacent walls are vertically connected without any vertical member using fastening means between overlapping surfaces of only each next adjacent timber; wherein polymeric synthetic resinous, adhesive means are used to fasten overlapping timber surfaces at the intersection of end-adjacent wall members; which wall structure may be fabricated with light-permeable flexible glass-fiber reinforced synthetic resinous materials between load-bearing timbers, to light up the inevitably dark interior of a conventional log cabin, and to decrease the reliance upon electrically powered light generating means; and which wall structure is readily adaptable for use with numerous building styles and conventionally constructed walls, with economics of fabrication and use.

It is a still further object of this invention to provide a new and improved log cabin structure obtaining one or more of the objects and advantages set forth above.

These and other objects, features and advantages of this invention will become apparent to those skilled in the art from the following description of preferred forms thereof, reference being had to the accompanying drawings and appended claims.

BRIEF DESCRIPTION OF THE DRAWINGS

The invention is illustrated in the accompanying drawings wherein.

In the figures of the drawing, like reference numerals are used to denote like parts. Some of the parts have been dimensionally exaggerated for clarify of illustration and to facilitate the description of the operation of the apparatus.

DETAILED DESCRIPTION OF PREFERRED EMBODIMENTS

Figure 1:
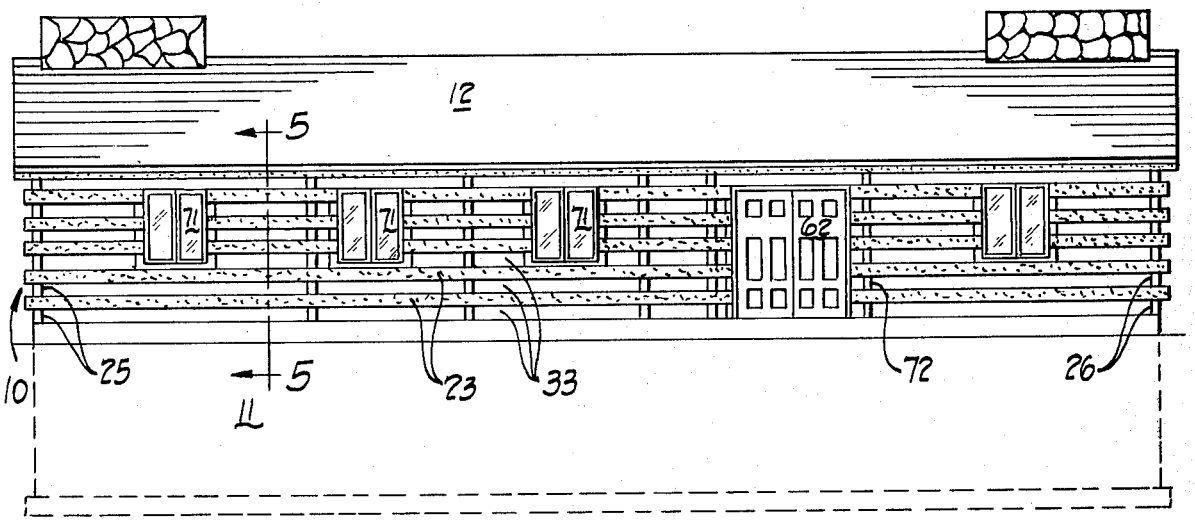
FIG. 1 is a front elevational view illustrating a preferred embodiment of a dwelling unit constructed in accordance with the teachings of my invention.

Briefly, the log building structure of this invention and the process for building such a structure embody the advantages of utilizing one of man's first building materials, namely lumber, in combination with one of man's latest, namely synthetic resinous materials, in a surprisingly cost-effective manner. More surprisingly, end-adjacent vertical walls of this structure may be fixedly held without a vertical log member between the end-adjacent walls. This is accomplished in a simple and direct manner by fastening only the overlapping end surfaces of log members of end-adjacent walls, one surface to the next adjacent surface, by simple fastening means, preferably using a polymeric synthetic resinous adhesive. Not only is the building structure of this invention economical and easy to construct, but it can be constructed quickly. Moreover, timbers which are relatively difficult and expensive to transport over great distances, are generally available close to the building site, and the laminar plastic panel members are convenient to fabricate and exceptionally easy to transport over great distances.

Still further, though log cabin structures are nostalgic and traditionally desirable for appearance's sake, they are predictably notoriously dark within. Thus over the years, all but the most primitive log cabin structures have been built with considerable window area, contributing considerably to the cost of construction, the requisite skill implicit in setting glass windows in a rough log wall, and the inherent difficulty in minimizing heat losses from within the structure. In the most preferred form of this invention, twin light permeable plastic panels are used between successive timbers in a course of timbers which form a wall. Though it will be apparent that the structure of this invention may be constructed from any generally uniform logs, it is preferred to use timbers, such as those of rectangular cross-section, commonly available. Most preferred are uniform rough-sawn 6 × 8 timbers, made fire retardant or suitably fireproofed, which present rectangular faces both interiorly and exteriorly. These rectangular faces of the timbers alternated with arcuate faces of the plastic panels, as will be described hereinafter, present a wall surface which is easy to clean and exceptionally attractive. When a more rustic visual effect is desired, generally cylindrical logs may be used, the surfaces of which complement the arcuate surfaces of interdisposed plastic panels. It is essential that, whatever the cross-section of a wood load-bearing member used, at least two opposite surfaces present sufficient area to permit the insertion of plastic panels spaced about 2 inches apart. In the description hereinafter, the load bearing wood members whether logs or timbers, will be referred to as "timbers" since these are used in the most preferred embodiment illustrated.

The plastic panels referred to may be made of any weather-resistant, fire-retardant, synthetic resinous material which can be fabricated into flexible laminar strips or panels; i.e., a strip or panel which can be bent along the longitudinal axis. Each panel is of essentially the same length as the horizontal timbers between which it is to be inserted, and generally about the same width as the timbers. The thickness of each panel is such as to permit the vertical flexing of the panel about a horizontal axis, yet thick enough to insure against damage from the elements. Preferred materials for the panels are the fire-retardant plastics favored for building construction such as the polyesters, particularly the glass fiber reinforced plastics; acrylates, particularly the methyl methacrylate; polycarbonates, particularly those having temperature insensitivity and scratch-resistance; and, butyrates, particularly those which are resistant to ultraviolate degradation. Most preferred are those panels which are translucent or transparent, by which is meant that the panels have a substantial permeability to visible light. These panels are generally fabricated by a low-cost continuous extrusion process which permits either rough or smooth-surfaced panels, or panels rough-surfaced on one side and smooth-surfaced on the other, to be economically purchased for use in this invention. The smooth surfaces of the panels permits them to be easily washed clean. Most economical are panels made by reinforcing polyesters with various fibers such as asbestos fibers, synthetic filaments, and especially glass fibers. Such panels may be obtained in any desired uniform thickness, opaque, translucent or essentially transparent, colored or tinted if desired, or essentially water white. For maximum light transmittance panels of methyl methacrylate commercially available as Plexiglas, or of polycarbonate commercially available as Lexan or Tuffak, are preferred.

Figure 2:
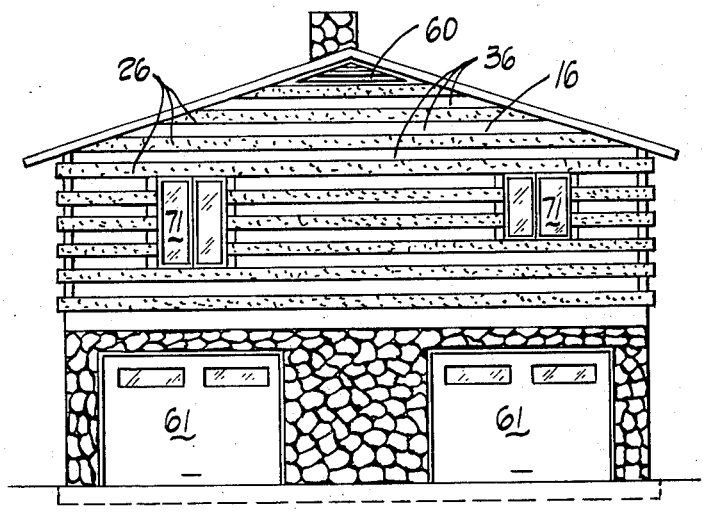
FIG. 2 is a right side elevational view of the structure illustrated in FIG. 1.

Referring now to the drawings and particularly to FIG. 1 in detail, the buidling structure or dwelling unit, hereinafter referred to as a house and indicated generally by the reference numeral 10, is built upon a rectangular base indicated generally by the reference numeral 11, such as a conventional basement structure. Of course, it is not essential that the house 10 be built on a basement structure, and the house can be built on a "slab" of concrete, if no basement is desired. The house comprises plural vertical walls arranged in end-adjacent relationship to form a rectangular unit. Several rectangular units may be interconnected, as will be described hereinafter, to provide the desired number of rooms in the house. The house is provided with a conventional roof, indicated generally by the reference numeral 12, and such masonry work for fireplaces, garage walls and the like (as shown in FIG. 2) as may be desired. If desired a single large rectangular unit may be constructed having a front wall 13, a rear wall 14, a left end wall 15 and a right end wall 16, each wall fastened in end-adjacent relationship with an other, and the large unit subdivided into desired units by conventional construction methods.

The walls 13–16 are constructed from plural 6 × 8 inch timbers designated as front timbers 23, rear timbers 24, left end timbers 25 and right end timbers 26, which may be of the same lengths to form a square structure, or the end timbers may be of a different length from the front and rear timbers to form a rectangular structure as illustrated herein. Each wall is formed by laying a plurality of timbers, one in vertically spaced apart relationship with the next adjacent timbers, so that the longitudinal axes of the timbers in a wall are in a vertical plane. Symmetrically disposed about this vertical plane are pairs of arcuate plastic panels, front panels 33 and 33', rear panels 34 and 34', left end panels 35 and 35' and right end panels 36 and 36', as will be described hereinafter.

Figure 5:
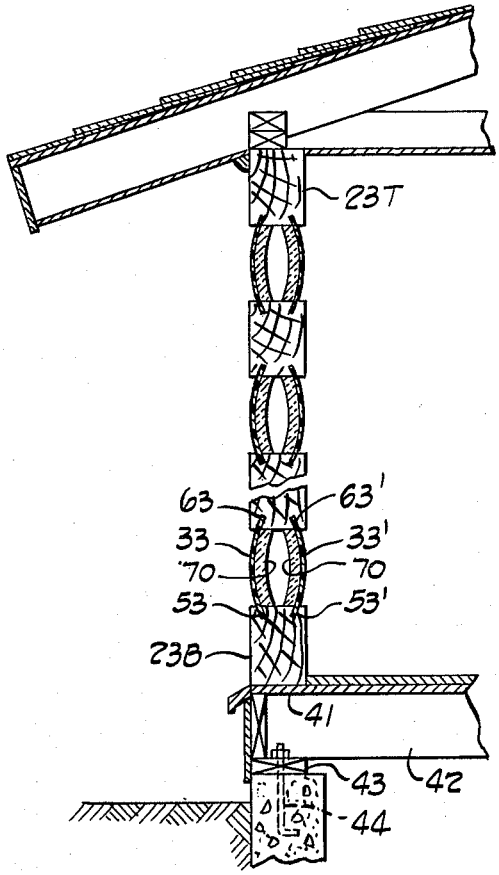
FIG. 5 is a vertical cross-section of an exterior front wall of the dwelling unit showing details of construction, viewed along the line 5—5 of FIG. 1.

Referring specifically to FIG. 5, there is illustrated a vertical cross-section of a front wall on the line 5—5 of FIG. 1, showing a base timber 23B laid on a subfloor 41 which in turn is laid on floor joists 42 positioned on the basement wall. Conventionally, floor joists 42, such as 2 × 10 inch timbers, are fastened on 12 inch centers to a sublying 2 × 6 inch timber 43. The timber 43 is anchored to the basement wall on 32 inch centers by anchor bolts 44. A finished floor 45 is usually laid on the subfloor 41.

The base timber 23B is provided with a pair of longitudinal grooves 53 and 53', exterior and interior respectively, in its upper surface and over its entire length. Each groove is inclined from the vertical, and the grooves are angulated symmetrically about the vertical plane through the longitudinal axis of the base timber 23B. It is critical that the grooves be angulated for insertion of the plastic panels, if it is desired to insert the panels after assembly of the timbers, though neither the extent of angulation or its direction, is critical. By direction of angulation is meant that the grooves may be cut in such a manner that the plastic panels may be inserted having a concave or convex surface. The symmetrically convex surfaces of plastic panels as shown, is preferred. This is achieved by cutting symmetrical grooves substantially equally spaced from the inner and outer edges, fore and aft, of each timber.

Figure 7:
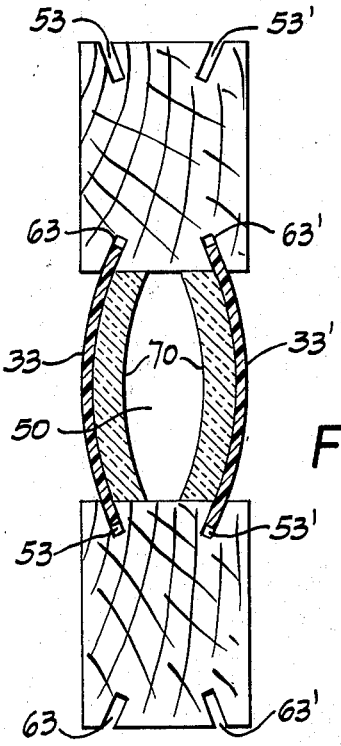

Succeeding horizontal timbers of each wall have pairs of longitudinal horizontal grooves cut in both the upper and lower surfaces of each timber, as shown in FIG. 7. The width of the grooves is sufficient to snugly accommodate the edges of the panels, and are deep enough to secure the panels in an arcuate position. As will be evident, upper grooves 53 and 53' of a timber are provided directly beneath lower grooves 63 and 63' of the next adjacent upper timber, and the relative positions of the grooves are such that an exterior front panel 33 and an interior front pabnel 33' may be conveniently inserted and secured as shown in FIG. 7, to form a confined zone 50, the panels being stressed by virtue only of the angulation of the grooves.

The panels are preferably continuous and extend to a corner formed by two end adjacent walls. The end of each panel of one wall abuts the inner surface of an orthogonally disposed timber of the end-adjacent wall. The line of abutment 51 of the end of the panel against a timber is preferably sealed with a caulking material to prevent leakage of air into or out of the confined zone 50 formed by each pair of panels and the upper and lower surfaces of successive timbers.

The width of the panels is not critical but must be sufficiently thin to permit the panels to be flexingly inserted between timbers. For appearance sake, it is preferred that the panels be substantially the same width as the exterior face of a timber. Since the panels are under no load, the load being borne by the timbers, the panels may be of arbitrary width determined by parameters well-known to those skilled in the art. Wider panels of light transmitting material will permit greater use of natural light.

The confined zone 50 may be left empty, but for cold climates, it is preferred that the zone 50 be provided with insulating material. Any insulating material may be used, but a glass fiber batt 70 is preferred, because it can be easily laid up against the panel surfaces inside the confined zone. For better light transmittance, a light transmitting insulation material such as glass frith, glass beads, hollow glass spheres and the like, is preferred.

Reverting now to FIG. 5, it is seen that a conventional roof is built upon the topmost timber 23T of the front wall. Details of conventional roof construction are illustrated but need not be described. Only the lower surface of the timber 23T is provided with a pair of parallel grooves 63 and 63'.

Figure 6:
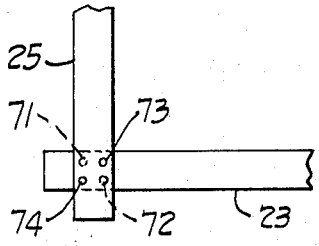
FIG. 6 is a plan view showing a portion of a corner of the structure and the manner in which each succeeding log is fastened to next abutting logs above and below it; and, FIG. 7 is a vertical cross-section of a portion of a wall, showing details of construction.

Referring now to FIG. 6 there is shown a detail of a portion of a corner formed by overlying ends of a front timber 23 and a right end timer 26 of end-adjacent perpendicularly disposed walls. The timbers are fastened at abutting surfaces only, preferably by adhesively securing one timber to the next. Preferred adhesives are of the silicon and polysulfide types which form a strong bond but retain sufficient resilience to accommodate weather changes. For ease of assembly each timber is provided with means for ensuring the precise rectangular relationship between succeeding timbers. This is conveniently accomplished by a pair of dowel pins 71 and 72 which are inserted in recesses provided in the upper surface of timber 23 and the lower surface of timber 26. Recessed holes 73 and 74 are shown in the upper surface of timber 26 in which dowel pins will be inserted to position the next timber. In a corner it is sufficient that the ends of timbers overlap, but it is preferred to have a slight overhang at each end.

Figure 3:
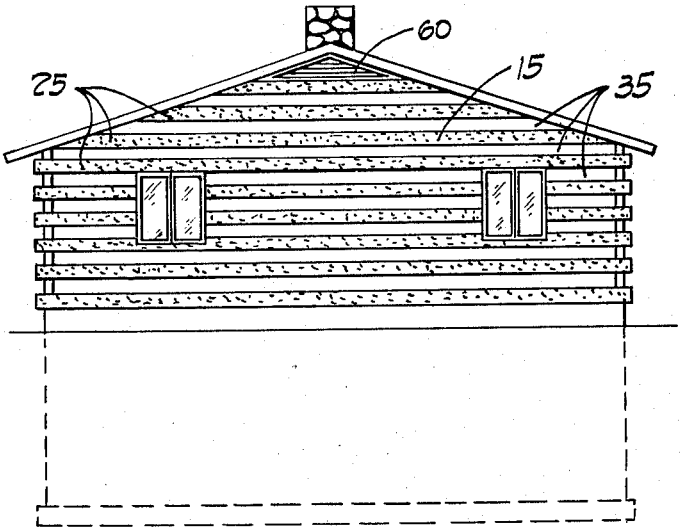
FIG. 3 is a left side elevational view of the structure illustrated in FIG. 1.
Figure 4:
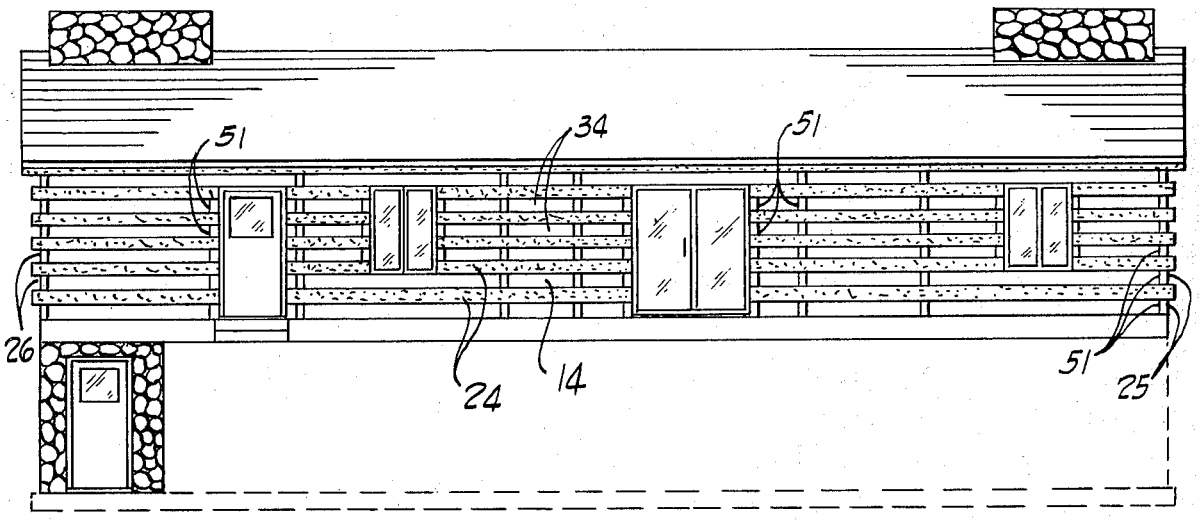
FIG. 4 is a rear elevational view of the structure illustrated in FIG. 1.

The front wall 13 of front timbers 23 is terminated with a front top timber 23T upon which the roof 12 is supported by means of roof joists in a conventional way. The rear wall 14 of rear timbers 24 is likewise terminated with a rear top timber (not shown) on which the rear portion of the roof is supported in a manner similar to the front. The front and rear walls are shown having the same height in FIG. 3, though this is not necessary, and the right and left end walls seen in FIGS. 2 and 3 respectively are gabled. The construction, alternating timbers and plastic panels, is continued until near the apex of the roof, where a roof vent 60 is provided in each end wall.

Referring further to FIG. 1 there is shown a double doorway 62 set in the front wall 13. The doorway 62 is preferably of the prefabricated sash type having a rectangular sash frame of dimensions so chosen to allow the door sash to rest on the floor joists 42 and have the top of the sash snugly fitted under a horizontal front timber 23. Spacer blocks 72 are provided between successive timbers, on each side of the door sash, to support the horizontal timbers. In addition, vertical timbers (not shown) may be used with spacer blocks, to frame and secure the windows accurately. The spacer blocks 72 may snugly abut the sides of the door sash, or may be spaced therefrom as shown. Where the blocks 72 are spaced apart as shown, a panel section is inserted between the spacer block and the side of the door sash and sealed in the same manner as the elongated panels inserted between successive timbers.

As seen in FIG. 2, the lower wall of the house may be of conventional masonry construction, and garage doors 61 are provided in the end wall, in a conventional manner.

Referring further to FIG. 1, there may be provided several front windows 71 to provide light and air, and also for the sake of appearance. It is preferred to use insulated windows preferably of twin glass panels seated in spaced apart relationship with each other, in prefabricated sashes of predetermined dimensions. The height of a sash is so chosen that it fits snugly between preselected timbers in a course, and the weight of the window structure is supported by the upper face of the timber on which the sash rests. Spacer blocks 72 are provided between successive timbers and abut the sides of the window sash, so that the sash is sealed in the wall, with all its sides tightly abutting the wood surfaces of the timbers and the spacer blocks. Referring now to FIG. 2 there is shown a sash 76 of a different size from the sashes 71 set in the front wall and in the right end wall. As many windows may be provided as are desired. All windows set in the walls of this house in the manner just described, bear essentially no load, and can thus be fabricated relatively economically.

The house is erected with a minimum of skilled labor, by laying the subfloor on floor joists set on the foundations of the house, in a conventional manner. The base timbers for each wall are then placed on the floor joists and fastened thereto. Only the upper faces of the base timber need be grooved for the plastic panels which are inserted between the base and a succeeding timber. Timbers of the end walls are stacked so that the ends overhang about 4 to 6 inches. Where dowel pins are provided, the timbers assume perpendicular (rectangular or right angle) relationship. If not provided, the timbers are set for the desired rectangular configuration. The faces of abutting timbers are coated, on the area of contact, with adhesive sealing means and the plastic panels inserted between successive timbers. The front and rear walls terminate with top timbers on which the roof is to be supported. Spacer blocks 72 are provided as necessary for the windows and doors desired. At least the lower edges of the plastic panels are caulked with a weather resistant sealing material.

A glass fiber batt is inserted and pressed against one panel, then one or more additional batt to the desired thickness, are placed between successive timbers and the second panel is inserted between the successive timbers. Alternatively, the batts may be adhered to the inner, relative to each other, side of each panel, as by an adhesive or other means before the panel is inserted in the grooves to insure that the batts remain against the panel and resist settling.

Where desired, piping and electrical conduit means may be placed between horizontal timbers in a wall. All interior walls are preferably fastened to the exterior walls, particularly if the interior walls are also of the timber and panel type of construction.

Modifications, changes and improvements to the form of the invention herein disclosed, described and illustrated may occur to those skilled in the art who come to understand the principles and precepts thereof. Accordingly, the scope of the patent to be issued hereon should not be limited to the particular embodiments of the invention set forth herein, bu rather should be limited by the advance by which the invention has promoted the art.

I claim:

1. A log cabin structure comprising load-bearing logs or timbers and essentially load-free panels disposed therebetween forming end-adjacent walls having end portions of said timbers interdigitated in direct load bearing relationship one on the other, free of a common vertical loadbearing member, each end-adjacent wall having plural horizontal timbers of generally uniform cross section maintained in spaced apart parallel relationship by interdigitation of said end portions, said timbers having a pair of longitudinal grooves in the upper and lower faces thereof, said grooves being in parallel spaced apart relationship over the length of said timbers, and said grooves having a preselected depth and width chosen so that each groove snugly accommodates one longitudinal edge of each of a pair of essentially no-load-bearing elongated laminar plastic panels to form a confined zone bounded by upper and lower timber surfaces, the inner surfaces of said panels and end surfaces of timbers of another wall, and fastening means to fasten said timbers rigidly relative to one and another.

2. The log cabin structure of claim 1 wherein each said end portion is fastened to abutting upper and lower interdigitated timbers only.

3. The log cabin structure of claim 1 wherein said fastening means is an adhesive means.

4. The log cabin structure of claim 1 including a base timber and a top timber having only one longitudinal face provided with a pair of parallel spaced apart longitudinal grooves in said face.

5. The log cabin structure of claim 1 wherein said confined zone has thermal insulating material disposed therewithin.

6. The log cabin structure according to claim 5 wherein said insulating material is in batt form adhered to the said panels, respectively.

7. A log cabin structure comprising load-bearing logs or timbers and essentially load-free panels disposed therebetween forming end-adjacent walls having end portions of said timbers interdigitated in direct load bearing relationship one on the other, free of a common vertical load-bearing member, each end-adjacent wall having plural horizontal timbers of generally uniform cross section maintained in spaced apart parallel relationship by interdigitation of said end portions, said timbers having a pair of longitudinal grooves in the upper and lower faces thereof, said grooves being in parallel spaced apart relationship over the length of said timbers, and said grooves having a preselected depth and width chosen so that each groove snugly accommodates on longitudinal edge of each of a pair of elongated laminar light transmitting plastic panels to form a confined zone bounded by upper and lower timber surfaces, the inner surfaces of said panels and end surfaces of timbers of another wall, and fastening means to fasten said timbers rigidly relative to one and another.

8. The log cabin structure of claim 6 including sealing means to seal all exterior joints of said structure.

9. The log cabin structure of claim 1 wherein said grooves are disposed at an angle from the vertical to permit insertion of upper and lower edges of said panels after assembly of said timbers.

10. The log cabin structure of claim 9 wherein at least one panel is flexed to assume a convex exterior surface.

11. The log cabin structure of claim 10 wherein the outer panel of said pair of panels is flexed to assume a convex interior surface.

* * * * *